United States Patent [19]

Grabbe et al.

[11] 4,370,012

[45] Jan. 25, 1983

[54] ELECTRICAL CONNECTOR FOR CIRCUIT BOARD OR SUBSTRATE

[75] Inventors: Dimitry G. Grabbe, Lisbon Falls, Me.; Iosif Korsunsky, Harrisburg, Pa.

[73] Assignee: AMP Incorporated, Harrisburg, Pa.

[21] Appl. No.: 208,734

[22] Filed: Nov. 20, 1980

[51] Int. Cl.[3] ..... H01R 13/629

[52] U.S. Cl. ..... 339/75 MP; 339/176 MP

[58] Field of Search ..... 339/17 CF, 17 LM, 17 M, 339/75 M, 75 MP, 176 MP

[56] References Cited

U.S. PATENT DOCUMENTS

| | | | |
|---|---|---|---|
| 3,107,961 | 10/1963 | Hahn et al. | 339/75 MP |
| 3,259,807 | 7/1966 | Drugan et al. | 317/101 |
| 3,569,904 | 3/1971 | Hill et al. | 339/75 |
| 4,087,148 | 5/1978 | Bauerle | 339/75 MP |
| 4,176,900 | 12/1979 | Hines et al. | 339/176 MP |
| 4,261,631 | 4/1981 | Guilcher et al. | 339/75 MP |

FOREIGN PATENT DOCUMENTS

| | | | |
|---|---|---|---|
| 2408274 | 6/1979 | France | 339/75 M |

*Primary Examiner*—John McQuade

*Attorney, Agent, or Firm*—Frederick W. Raring

[57] ABSTRACT

Edge connector comprises a housing assembly having a board receiving trough which receives edge portions of a printed circuit board. The housing assembly comprises an insulating housing in which contact terminals are contained and a sheet metal frame of channel-shaped cross-section in which the insulating housing is nested. A camming means is mounted on the sheet metal frame for urging the circuit board against a board engaging surface portion of the insulating housing and an auxiliary spring is mounted on the frame to provide a high clamping force on the circuit board. The camming means is movable laterally towards and away from the board engaging surface so that the connector can receive circuit boards of widely varying thicknesses.

8 Claims, 9 Drawing Figures

ELECTRICAL CONNECTOR FOR CIRCUIT BOARD OR SUBSTRATE

FIELD OF THE INVENTION

This invention relates to circuit board edge connectors which receive edge portions of a printed circuit board and which contain contact terminals that establish electrical contact with conductors on one surface of the circuit board.

BACKGROUND OF THE INVENTION

A widely used interconnection system for electrical components comprises a relatively large circuit board, commonly referred to as a mother board, having a plurality of circuit board edge connectors mounted on one surface thereof. The circuit board edge connectors are adapted to receive the edge portions of smaller printed circuit boards, commonly referred to as daughter boards, and the connectors serve to connect terminal pads or conductors on the daughter boards to conductors on the mother board thereby to achieve the required circuits among the numerous components mounted on the daughter boards. Interconnection systems of this type are highly versatile and completely serviceable, since the daughter boards can be individually removed from their respective connectors and replaced for service purposes.

The increasing complexity of electrical and electronic equipment and the continuing reductions in the sizes of the electrical components used gives rise to the demand for circuit board connectors of smaller and smaller dimensions which are capable of accommodating daughter boards having their terminal pads on closer and closer center-to-center distances. Additionally, there are increasing requirements for circuit board edge connectors capable of receiving daughter boards having relatively large numbers of terminal pads thereon, for example, daughter boards with up to 200 terminal pads located along one edge are coming into widespread use, and the connectors for these daughter boards must be capable of receiving these edge portions and establishing contact with each of the terminal pads on the daughter board.

A further requirement of circuit board edge connectors is that the connector be designed such that an adequate contact force will be developed at each of the electrical interfaces between the contact terminals in the connector and the terminal pads on the daughter board. When the contact terminals and the terminal pads are gold plated, the contact force at each electrical interface need not be excessively high, but if a contact material other than gold is used on the circuit board, for reasons of economy, a relatively high contact force is required. For example, while 200 grams is commonly considered to be adequate for gold plated contacts, a force of 600 grams is required if the contact meterial is of tin or a tin-lead alloy.

The present invention is directed to the achievement of an improved circuit board edge connector which will satisfy the increasingly severe requirements of edge connectors which are now being specified by equipment manufacturers. The invention is thus directed to the achievement of a circuit board edge connector which has the capability of providing a relatively high contact force at each of the electrical interfaces established when a circuit board is mated with a connector, which provides contact terminals in the connector on closely spaced centers so that it can be used with circuit boards having terminal pads on like centers, and which can be produced with a relatively large number of contact terminals therein so that it is capable of accommodating circuit boards having a high number of terminal pads. The invention is further directed to the achievement of circuit board edge connector which is highly compact relative to its capacity to receive a circuit board of given dimensions and which can be mounted on a mother board in a stack of closely spaced connectors, thereby to achieve extremely high density of electrical connections within a limited space.

A preferred form of circuit board edge connector in accordance with the invention comprises a housing assembly which consists of an insulating housing, a metallic frame assembly on the housing, and a camming means mounted in the frame assembly. The frame assembly has one wall portion which is spaced from a board engaging surface of the insulating housing, thereby defining a trough into which edge portions of a circuit board are inserted. The camming means mounted on the frame assembly engages one surface of the circuit board after it has been inserted and pushes the circuit board against the board engaging surface of the housing, thereby to press the terminal pads on the circuit board against contact portions of the contact terminals which are contained in the insulating housing. The camming means is movable laterally with respect to the board engaging surface so that circuit boards of varying thicknesses can be accommodated by the connector. A spring means on the housing assembly urges the camming means towards the board engaging surface and provides a controlled and predetermined contact force at each of the electrical interfaces where the contact terminals bear against the terminal pads on the circuit board.

PREFERRED EMBODIMENT OF THE INVENTION

Figure 1:
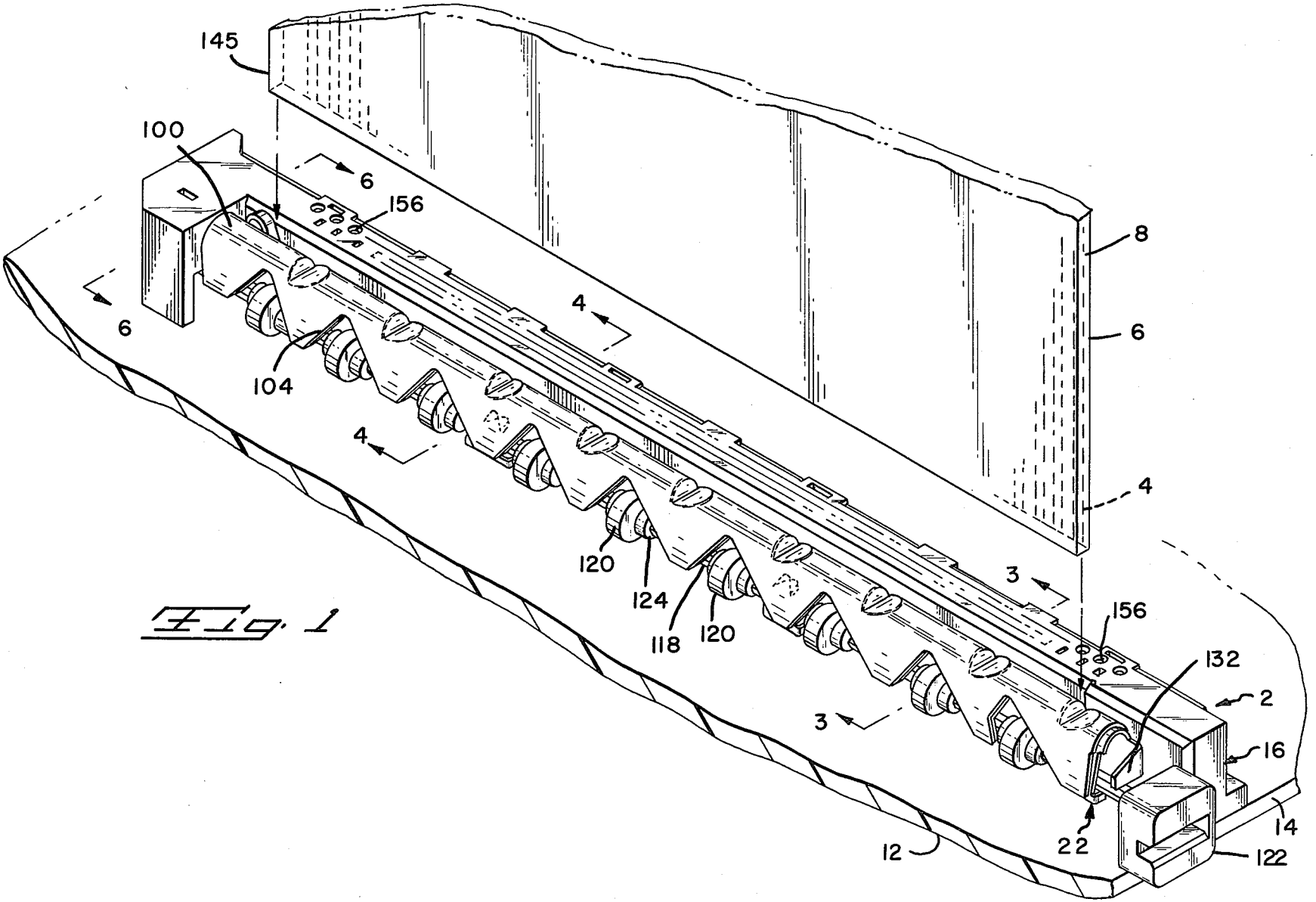
FIG. 1 is a perspective view showing a circuit board edge connector in accordance with the invention, mounted on one surface of a large circuit board with a smaller circuit board exploded from the connector.
Figure 8:
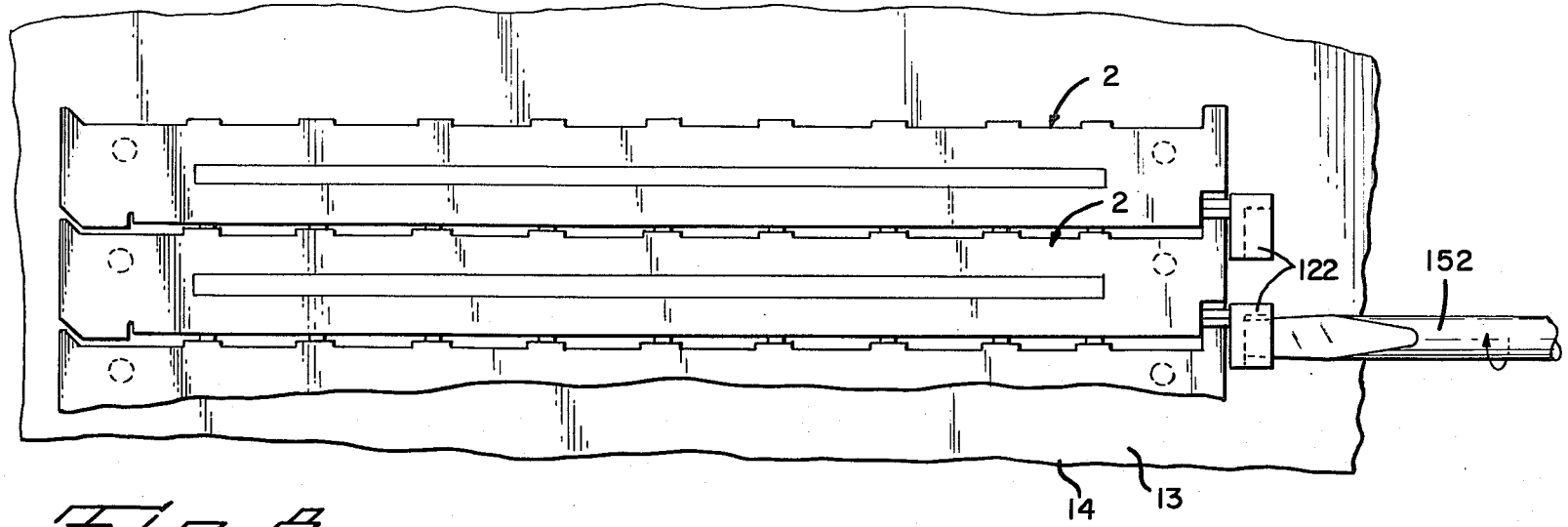
FIG. 8 is a plan view of a printed circuit mother board having connectors in accordance with the invention, mounted thereon and stacked against each other.

As shown in FIG. 1, a connector assembly 2 in accordance with the invention serves to connect conductors 4 on one surface 6 of a printed circuit daughter board 8 to conductors 10 (FIG. 5) on the underside 12 of a printed circuit mother board 14. As illustrated in FIG. 8, the connector assemblies 2 can be stacked against each other on the surface 13 of the mother board so that a large number of daughter boards 8 can be connected to the conductors on the underside 12 of the mother board.

The connector assembly 2 is made up of a housing assembly 16 which in turn comprises an insulating housing 20 and a frame assembly 22. The frame assembly in turn consists of a generally channel-shaped frame member 24 and a spring member 26 mounted on one sidewall of the frame member. A camming means 28 is carried in the frame assembly 22 for the purpose of camming edge portions of the circuit board against contact terminals 18 which are contained in the insulating housing 20.

Figure 2:
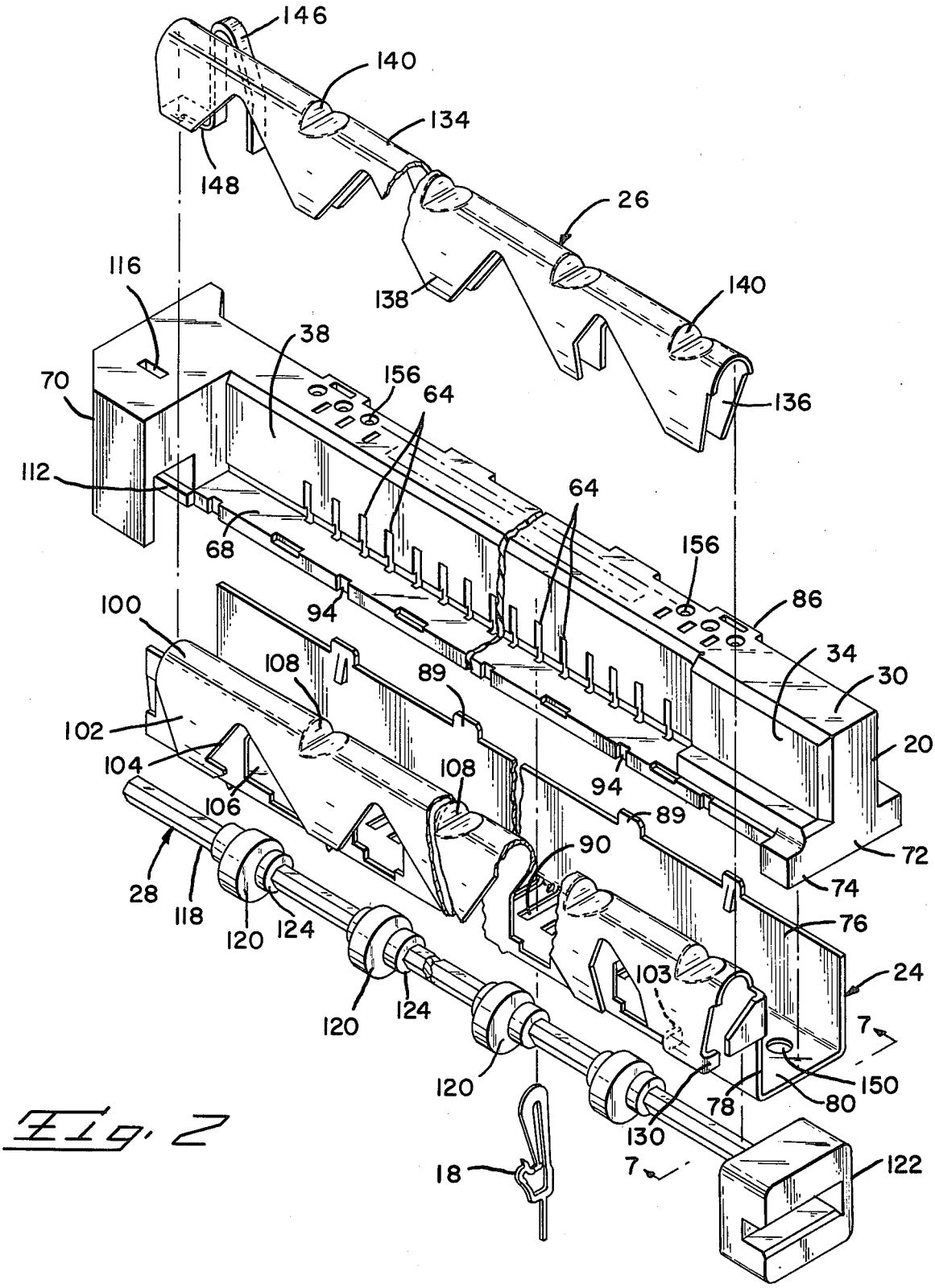
FIG. 2 is a perspective view showing the parts of the connector exploded from, and in alignment with, each other.
Figure 3:
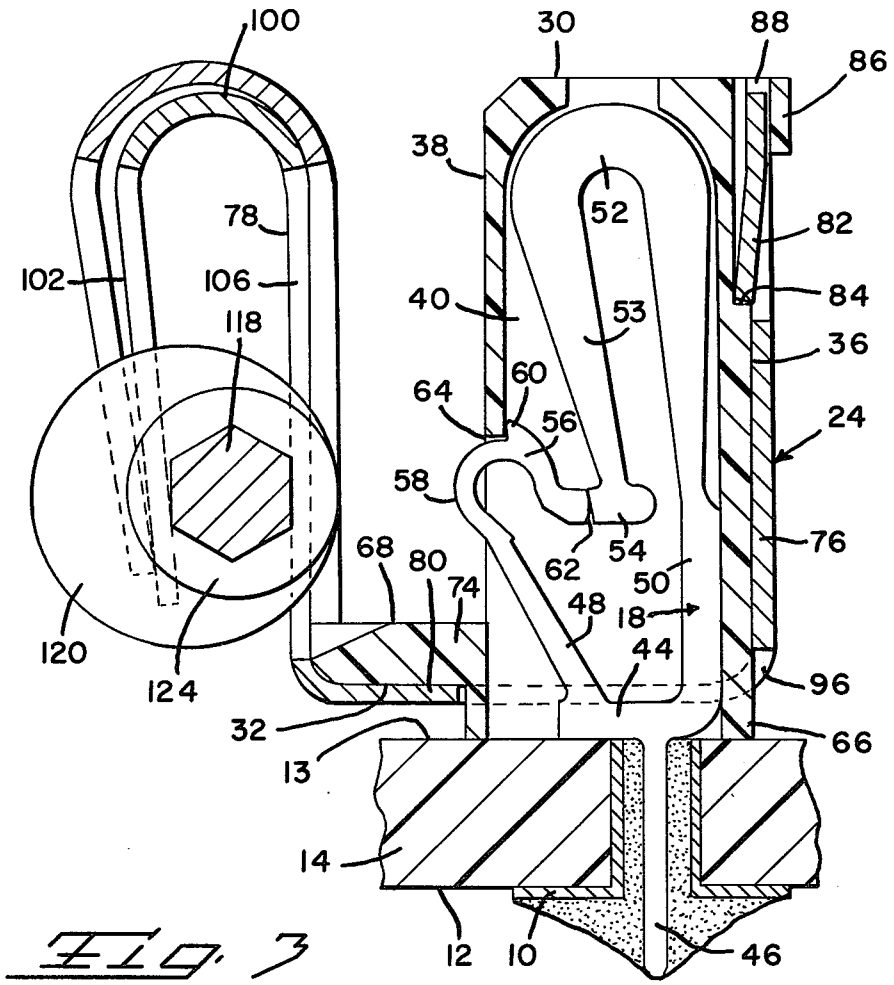

The housing 20 is of insulating material and has top and bottom surfaces 30, 32 and side surfaces 34, 36, as shown in FIGS. 2 and 3. The lefthand side surface 34 is recessed to provide a flat board engaging surface 38 against which the surface 6 of the circuit board 8 is pressed when the circuit board is mated with the connector. A plurality of side-by-side cavities 40, 42, see FIGS. 3 and 4, extend upwardly from the bottom surface 32 into the housing and alternate cavities 40 contain contact terminals 18, while the remaining cavities 42 are vacant. These remaining cavities in the housing facilitate molding of the housing and also improve the dielectric characteristics of the housing.

Figure 5:
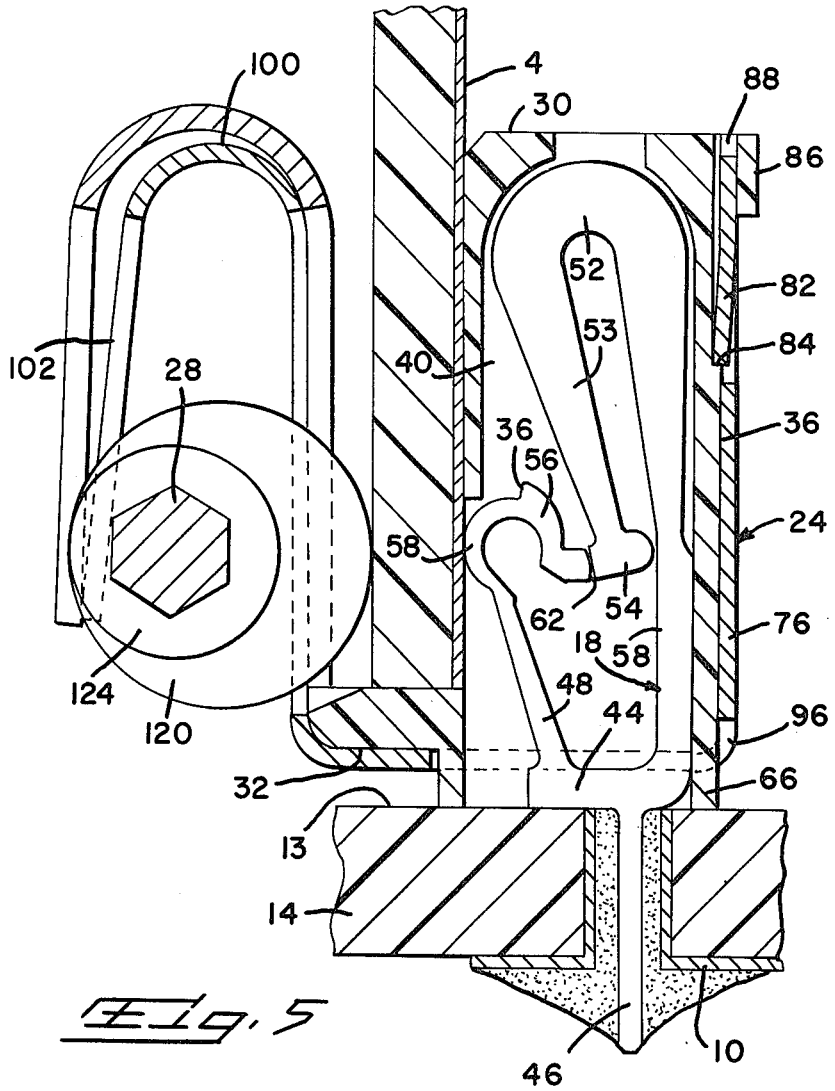
FIG. 5 is a view similar to FIG. 3, but showing the positions of the parts when a circuit board is mated with the connector.

Each terminal 18 comprises a horizontally extending yoke portion 44, a solder tab 46 which extends downwardly, as viewed in FIG. 3, from the yoke portion, through a hole in the circuit board 14 and is soldered, as indicated, to a conductor 10 on the underside 12 of the circuit board 14. A contact arm 48 extends upwardly and leftwardly, as viewed in FIG. 3, from the yoke and spaced from this contact arm a spring arm 50 is provided. The spring arm extends beyond the upper end of the contact arm, is reversely curved at its upper end 52, and has an enlarged free end 54. The free end portion of the contact arm 48 is generally circular, as shown at 56, and extends to a bearing portion 62 which bears against the enlarged end 54 of the spring arm. The circular end portion of the contact arm projects through an opening 64 in the housing wall so that the contact portion 58 is spaced from the board engaging surface 38 of the housing. The contact arm and the spring arm are both in a flexed condition and are pre-loaded against each other in a manner such that the contact arm is displaced in a counter-clockwise direction by a slight amount, from its normal position, while the depending portion 53 of the spring arm is flexed rightwardly from what would be its normal position. A stop ear 60 is provided on the circular portion 56 of the contact arm to prevent it from moving leftwardly from the position shown in FIG. 3. When the circuit board is mated with the connector, as shown in FIG. 5, the contact portion 58 is displaced rightwardly from the position shown in FIG. 3 and the spring arm is flexed in the same direction. THe spring arm thus provides the contact force which presses the contact portion 58 of the contact arm against the conductor on the circuit board 8, but this spring arm does not perform a significant electrical function. The current flows from the conductor on the circuit board 8 through the contact arm 48 to the yoke 44 and then to the conductor 10 on the underside of the mother board 14.

The particular contact terminal 18 disclosed herein is manufactured by stamping flat metal stock so that all of the parts of the terminal lie in the plane of the original stock. Terminals of this type are fully described and claimed in our co-pending application Ser. No. 208,724. It will be appreciated, however, that the principles of the present invention, as regards the connector assembly and the components thereof, can be used with other types of contact terminals if desired.

The underside or bottom surface 32 of the housing 20 has spaced-apart projecting portions 66 which surround the yoke portions 44 of the contact terminals 18. These projecting portions are received in spaced-apart slots 90 in the web of the frame member 24. A ledge 68 is provided on the housing which intersects the board engaging surface 38 and which supports the edge of the printed circuit daughter board 8 when it is coupled to the connector, as shown in FIG. 5. The ends 70 and 72 of the housing are somewhat enlarged, as clearly shown in FIG. 2, and an ear 74 projects leftwardly, as viewed in FIG. 2, to support the frame member 24, as will be described below. The enlarged end 70 of the housing has a cavity or recess 112 therein which accommodates the end portion of the frame, as will also be described below.

Figure 6:
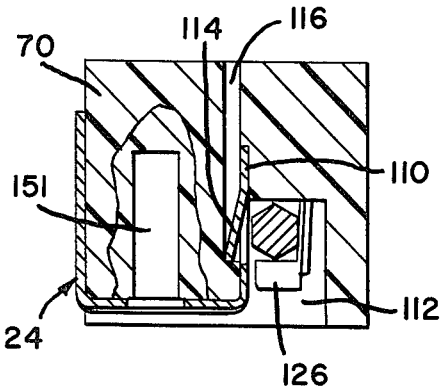
FIG. 6 is a view taken along the lines 6—6 of FIG. 1.

The frame member 24 is of stamped and formed sheet metal, preferably a carbon steel which can be readily formed, and is a generally channel-shaped cross-section having side walls 76, 78 and a web 80 which extends between the lower ends of the sidewalls. The sidewall 76 is disposed against the rightwardly facing external sidewall 36 of the housing and lances 82 struck from the sidewall 76 bear against shoulders 84 on the surface of the sidewall. Ears 86 are integrally molded on the sidewall adjacent to the upper surface 30 and are provided with openings 88 which receive tabs 89 on the upper edge of the frame sidewall 76. These lances 82, in part, retain the frame on the housing, although other retaining means are also provided, as shown in FIG. 6 and described below. As previously noted, the web 80 is provided with spaced-apart slots 90 which receive the projecting portions 66 on the surface 32 of the housing and these projecting portions and slots further assist in maintaining the frame in assembled relationship to the housing.

Figure 4:
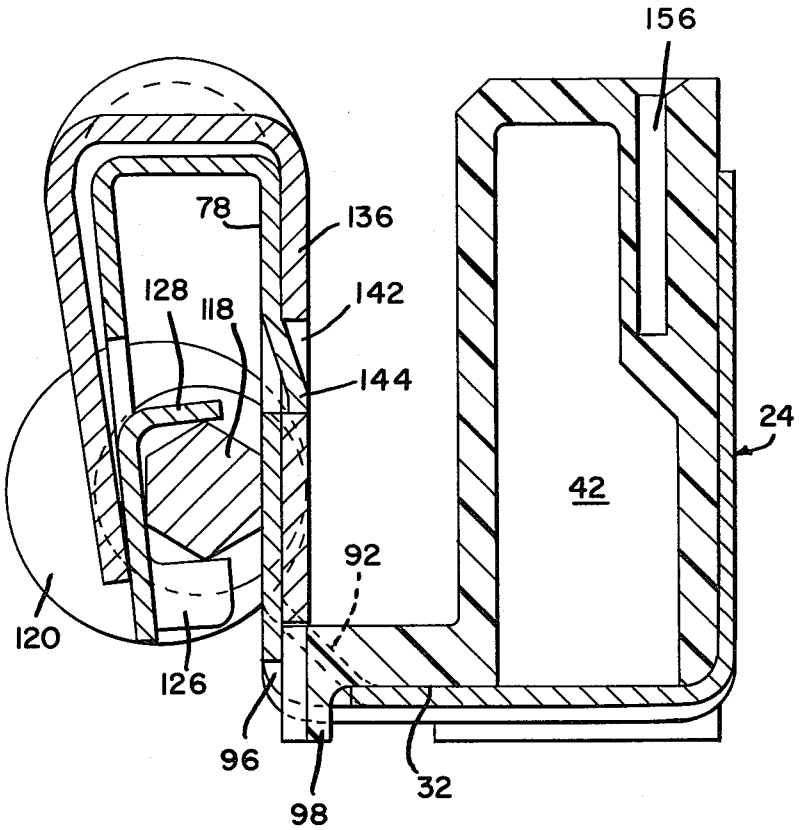
FIGS. 3 and 4 are views taken along the lines 3—3 and 4—4 of FIG. 1.
Figure 7:
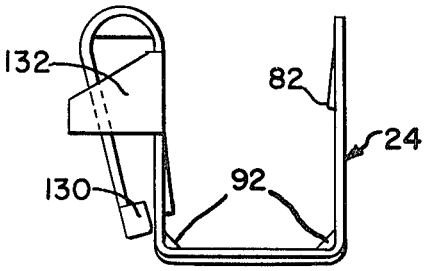
FIG. 7 is an end view looking in the direction of the arrows 7—7 of FIG. 2 of the frame portion of the connector.

As shown best in FIG. 7, spaced-apart dimples 92 are formed on the sides of the web by inwardly indenting the frame at the corners defined by the sidewalls and the side edges of the web. These dimples 92 are received in corresponding recesses in the corners of the housing, recesses being shown at 94 along the side edge of the ledge 68 and corresponding recesses are provided on the lower portions of the side 36 of the housing. The housing also has integral supporting legs 98 extending from its lower surface 30, which project through openings 96 in the frame, as shown in FIG. 4. Suitable supporting legs, as required, are provided on both sides of the surface 30 and corresponding openings 96 are provided in the web of the frame, as required.

The sidewall 78 of the frame is reversely formed, as shown at 100, at its upper end to provide depending spaced-apart flanges or aprons 102 which are separated by generally triangular openings 104. The openings 104 are in alignment with openings 106 in the sidewall, thereby to provide clearance for the cams 120 of the camming means 28. The reversely formed portion 100 is indented as required, and as shown at 108, to stiffen it against flexure, although some flexure is required, as will be described below.

The lefthand end portion of the sidewall 78 projects beyond the reversely formed portion, as shown at 110 and extends into a recess 112 in the enlarged end portion 70 of the housing 20. A lance 114 is provided on the sidewall at this end portion and bears against a suitable shoulder in the recess 112, as shown in FIG. 6, this shoulder being formed by a core pin during the molding process so that an opening 116 remains which extends upwardly to the upper surface 30 of the housing.

The camming means 28 of the disclosed embodiment is in the form of a hexagonal shaft 118 having spaced-apart eccentric circular cams 120 molded thereon.

At its righthand end as viewed in FIG. 2, a head 122 is mounted on shaft 18 and is provided with a kerf so that the shaft can be rotated by a screw driver, as shown at 152 in FIG. 8. The circular cams 120 each have an associated supporting hub portion 124 and may be formed by simply molding a stiff polyester or other plastic molding material on the shaft, suitable material being Rynite 545, which is supplied by the DuPont Company.

Shaft 118 is supported between the opposed surfaces of the flanges 102 and the sidewall 78 by supporting ears 126, see FIGS. 4 and 6, which extend from the lower portions of the flanges 102 so that the shaft rests on the edges of these ears. The shaft is also confined by upper supporting flanges or ears 128 which are struck from the depending flanges 102. Additional support for the shaft is provided by an ear 130 which extends inwardly from the flange 103 at the righthand end, as viewed in FIG. 2, of the frame. An upper supporting ear 132 also extends inwardly and over the shaft from the sidewall 78 at the righthand end of the frame.

The spring member 26 is also of stamped and formed sheet metal, preferably stainless steel, or other material having good spring properties. The spring member is generally U-shaped and dimensioned to be fitted over the flanges 102 and the sidewall 78 and has a reverse bend as shown at 134, from which flanges or aprons 136, 138 depend, the flanges 136 being against the sidewall 78 and the flanges 138 being against the depending aprons 102. The spring member may also be indented, as shown at 140, for enhanced stiffness. The spring member is retained on the frame by means of lances 144 which are struck from the sidewall 78 and which extend into openings 142 in the flanges 136 of the spring member, see FIG. 4.

In order to position the circuit board accurately in the connector, a biasing spring for the edge 145 of the circuit board is provided on the spring member, as shown at 146. This biasing spring is integral with the lefthand end of the spring member and extends from an ear 148, the surface of this biasing spring being engageable with the edge of the circuit board when the circuit board is inserted into the connector.

Connectors in accordance with the invention can be mounted on the surface of the mother board by screws or the like, which would extend through screw holes 150 in the web 80 of the frame member. Also, self-tapping screws can be passed through the mother board 14 and threaded into openings in the housing 20 as shown at 151 in FIG. 6. The connectors can be closely stacked against each other as shown in FIG. 8 and the camming shafts of the connectors rotated by means of the blade 152 of a screw driver inserted into the kerf in the head of the cam shaft.

Figure 9:
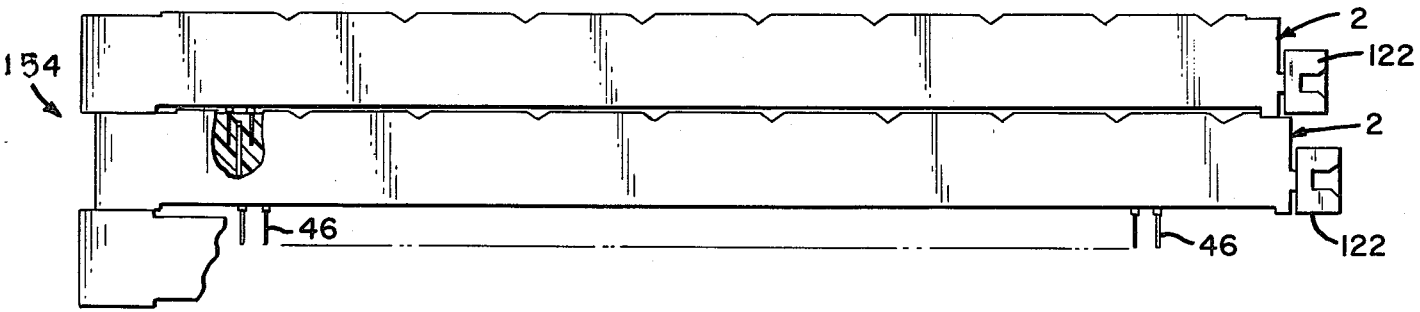
FIG. 9 is a view showing connectors in accordance with the invention, stacked against each other prior to installation on the mother board for storage or shipment.

At the time of manufacture, the connectors can be stacked against each other as shown in FIG. 9, for storage and shipment. Advantageously, openings 156, FIG. 4, extend inwardly from the upper surface 30 of the connector housing and when connectors are stacked on top of each other, the solder tab portions 46 of each connector will be received in the openings 156 of the adjacent connector.

The circuit boards 8 are assembled to the connectors by rotating the cam shafts to the positions shown in FIG. 3 and then positioning the edge portions of the circuit boards in the connectors with the sides 8 of the circuit boards opposed to the surfaces 38 of the connectors. The cam shaft of each connector is then rotated through an angle of 180° to the position of FIG. 5 so that the cam moves against the reverse surface of the circuit board 8 and firmly presses the surface 6 against the board engaging surface 38 of the connector housing. The contact arms 48 of the terminals will then be flexed inwardly and in the final position of the parts, FIG. 5, the contact portions of the terminals will bear against the conductors 4. During rotation of the cam shaft, the individual cams 120 will rotate in a clockwise direction, as viewed in FIGS. 3 and 5, and as the cams come into engagement with the circuit board, they will urge it downwardly, as viewed in these drawings, thereby ensuring complete insertion and accurate positioning of the circuit boards in the connectors, even if the boards are initially carelessly positioned by the technician. The cam shaft floats in the frame assembly, as is apparent from FIGS. 3 and 5, and moves somewhat leftwardly during rotation. The leftward movement of the cam shaft results in the development of substantial stresses in the spring member 26 so the cams are pressed firmly against the circuit board, thereby ensuring stable electrical contacts.

An important feature of the invention is that circuit boards of widely varying thicknesses can be accommodated in a given connector, by virtue of the floating support of the cam shaft in the frame assembly. This feature is highly advantageous under the circumstances where different types of daughter boards 8 might be used in electrical equipment. One embodiment of the invention, for example, can accommodate circuit boards ranging in thickness from 0.6 mm to 1.6 mm. Conventional epoxy or glass-filled boards generally have a thickness of about 1.6 mm, but under some circumstances, steel circuit boards having enamel coatings on their surfaces are used, and these circuit boards have a thickness of 0.6 mm. Obviously, circuit boards of intermediate thickness can also be accommodated.

The fact that the cam shaft 118 is provided with multiple individual cams 120 at spaced locations along its length is advantageous in that uniform application of the clamping pressure to the reverse side of the daughter board 8 is achieved so that all of the electrical contacts between the terminals and the conductors on the daughter board will be effectively established and the contact forces will be uniform. Additionally, circuit boards are quite often warped, as received by the user, and must be held in a flexed and flattened condition in the connector. The spaced-apart cams 120 on the cam shaft will bring about such straightening of a warped board.

When the cam shaft 118 is rotated from the position of FIG. 3 to the position of FIG. 5, the cams are effectively on center; that is, the reaction forces are imposed in a horizontal direction against the periphery of each cam are directed through the axis of the cam shaft and there is therefore no tendency for the cam shaft to rotate slightly in a counter-clockwise direction as the result of vibration or other incidental disturbances.

Connectors in accordance with the invention can be produced in any desired size and of a wide variety of materials. The principles of the invention will permit the achievement of high forces when required, and the connectors themselves can be of minimum size relative to the dimensions of the circuit boards. For example, a forty position connector in accordance with the invention, intended to receive circuit boards having the conductors 4 on 2.5 mm centers has an overall length of only about 130 mm and a width, as measured between the sidewall 36 and the outer side of the spring, of only 12.5 mm. It is entirely practical to produce connectors, of the type illustrated in the drawing, having two hundred terminals in the housing and such connectors would be proportionately longer than the connector illustrated.

Maximum contact forces can be achieved in connectors in accordance with the invention, by the use of a metallic frame member 24 and a separate stainless steel spring member on the frame member, as described above. An advantage of this arrangement is that the insulating housing 20, which is of plastic material, is nested within the relatively strong steel frame member and is stressed primarily in compression so that it is able to withstand the stresses imposed when it is in use. The use of the stainless steel spring permits the achievement of extremely high contact forces, as previously noted, in excess of 600 grams at each contact, if desired. If lower contact forces are desired, separate spring members can be eliminated and the frame member designed such that it will develop the required contact forces. Under some circumstances, the frame member itself might be produced as a plastic extension of the insulating housing and a separate spring mounted on the plastic frame, as required.

Connectors in accordance with the invention are of the zero insertion force or ZIF type, in that the contact terminals are not in engagement with the circuit board while the board is being positioned in the connector.

In the foregoing description, the circuit member 8 is described as a circuit board. This term is used in a generic sense and would therefore include those types of circuit devices commonly referred to as substrates, which are usually thinner than plastic circuit boards and which have circuit components, such as resistors and capacitors, formed directly on their surfaces.

We claim:

1. A circuit board or substrate edge connector of the type comprising housing means which is intended to receive edge portions of a circuit board and which contains contact terminals which engage, and establish contact with, terminal pads on one surface of said circuit board, said connector being characterized in that:

said housing means has a board engaging surface against which said circuit board is positioned when said edge portions of said circuit board are inserted into said housing means, said contact terminals having contact portions which normally extend beyond said board engaging surface and which are deflected towards said surface when said connector is assembled to said board;

said housing means having a board retaining portion which extends beside, and is spaced from, said board engaging surface, whereby a board receiving trough is formed between said board engaging surface and said board retaining portion, board clamping means in said board retaining portion for clamping a circuit board having edge portions thereof disposed in said trough against said board engaging surface, said board clamping means comprising a cam shaft in said board retaining portion, said cam shaft extending parallel to said board engaging surface and having eccentric cam means thereon which engage the surface of said circuit board which is the reverse surface from said one surface upon rotation of said cam shaft, said cam shaft being movable towards and away from said board engaging surface whereby, upon insertion of said edge portions of said circuit board into said trough and engagement of said board clamping means with said circuit board, said circuit board is clamped against said board engaging surface and said contact portions of said contact terminals are engaged with said terminal pads, said connector being usable with circuit boards of widely varying thickness by virtue of the fact that said board clamping means is movable towards and away from said board engaging surface.

2. A circuit board edge connector as set forth in claim 1, said eccentric cam means comprising spaced-apart eccentric cams on said cam shaft, said cams being effective during rotation of said cam shaft, to impose a first force component on said circuit board tending to push said circuit board against said board engaging surface and being effective to impose a second force component an said circuit board tending to push said circuit board into said trough.

3. A circuit board edge connector as set forth in either of claims 1 or 2, said housing means having spring means thereon urging said board clamping means towards said board engaging surface.

4. A circuit board edge connector of the type comprising a housing assembly which is intended to receive edge portions of a circuit board and which contains terminals which engage, and establish electrical contact with, terminal pads on one surface of said circuit board, said connector being characterized in that:

said housing assembly comprises an insulating housing having a board engaging surface against which said circuit board is positioned when said edge portions of said circuit board are inserted into said housing assembly, said contact terminals having contact portions which normally extend beyond said board engaging surface and which are deflected towards said surface when said connector is assembled to said board, a frame assembly on said insulating housing, said frame assembly being of stamped and formed sheet metal and having a board retaining portion which extends beside, and is spaced from, said board engaging surface, whereby a board receiving trough is formed between said board engaging surface and said board retaining portion, board clamping means on said board retaining portion for clamping a circuit board having edge portions thereof disposed in said trough against said board engaging surface, said board clamping means being movable towards and away from said board engaging surface whereby, upon placement of a circuit board in said trough and engagement of said board clamping means with said circuit board, said circuit board is clamped against said board engaging surface and said contact portions of said contact terminals are engaged with said terminal pads, said connector being usable with circuit boards of widely varying thickness by virtue of the fact that said board clamping means is movable towards and away from said board engaging surface.

5. A circuit board edge connector as set forth in claim 4, said frame assembly comprising a generally channel-shaped frame member having a web and sidewalls, said insulating housing being disposed on said web with one surface thereof, which is the reverse surface from said board engaging surface, against one of said sidewalls, the other one of said sidewalls being spaced from said board engaging surface, said web and said other sidewall constituting said board retaining portion.

6. A circuit board edge connector as set forth in claim 5, said other sidewall having a free end and being reversely formed at said free end to provide an apron extending beside said other sidewall, said board clamping means being supported between said other sidewall and said apron.

7. A circuit board edge connector as set forth in claim 6, said clamping means comprising a rotatable cam shaft having spaced-apart eccentric cams thereon, said cams being movable against the surface of said circuit board which is the reverse surface with respect to said one surface upon rotation of said cam shaft.

8. A circuit board edge connector as set forth in claim 7 having separate spring means for urging said cam shaft normally of its axis towards said board engaging surface.

* * * * *